US007125214B2

(12) United States Patent
Carrein et al.

(10) Patent No.: US 7,125,214 B2
(45) Date of Patent: Oct. 24, 2006

(54) COVER FEED ASSEMBLY

(75) Inventors: Jos Carrein, Bornem (BE); Raymond J. Gibbs, Stekenen (BE)

(73) Assignee: EMC Technologies, Inc., Houston, TX (US)

( * ) Notice: Subject to any disclaimer, the term of this patent is extended or adjusted under 35 U.S.C. 154(b) by 0 days.

(21) Appl. No.: 11/122,615

(22) Filed: May 5, 2005

(65) Prior Publication Data

US 2005/0207871 A1 Sep. 22, 2005

Related U.S. Application Data

(62) Division of application No. 10/410,499, filed on Apr. 7, 2003.

(51) Int. Cl.
*B21D 51/32* (2006.01)

(52) U.S. Cl. ..... 413/27; 413/35; 413/45

(58) Field of Classification Search ..... 413/45–52, 413/26, 27, 35; 53/308, 309; 72/94, 361
See application file for complete search history.

(56) References Cited

U.S. PATENT DOCUMENTS

| | | | | |
|---|---|---|---|---|
| 2,539,467 | A | 1/1951 | Pechy | |
| 2,579,976 | A | 12/1951 | Simpson | |
| 2,680,419 | A | 6/1954 | Peterson, Jr. et al. | |
| 2,746,413 | A * | 5/1956 | Peterson, Jr. | 413/52 |
| 2,750,913 | A * | 6/1956 | Pechy | 413/52 |
| 3,238,908 | A | 3/1966 | Gilbert | |
| 4,808,053 | A | 2/1989 | Nagai et al. | |
| 5,320,469 | A | 6/1994 | Katou et al. | |
| 5,839,869 | A | 11/1998 | Moran et al. | |
| 5,911,552 | A | 6/1999 | Shimizu et al. | |

FOREIGN PATENT DOCUMENTS

| | | |
|---|---|---|
| WO | WO 93/15957 A1 | 8/1993 |

* cited by examiner

*Primary Examiner*—Derris H. Banks
*Assistant Examiner*—Jimmy T. Nguyen
(74) *Attorney, Agent, or Firm*—Christensen O'Connor Johnson Kindness pllc

(57) ABSTRACT

Described is a seaming machine for use with a container (22) and an end closure (28). The machine includes a seaming head (62) with multiple shaft assemblies (100) and a lifter table (60) located below the seaming head (62) and including multiple container stations. During use, the lifter table (60) and seaming head (62) rotate in unison about the centerline of a spindle (64). A single shaft assembly (100) is provided at each station to perform a two-step seaming operation on its corresponding container (22). In one embodiment, a seaming cam (66) is located above the seaming head (62) for moving first and second cam followers (116), (118) in the shaft assembly (100). In another embodiment, the cam followers (116) and (118) have a master/slave relationship dependent on which step of the seaming operation is being conducted. In another embodiment, a single piece plate (122) is used in a cover feed assembly (120) and provides end closures (28) to a make-up point (30).

4 Claims, 10 Drawing Sheets

COVER FEED ASSEMBLY

CROSS-REFERENCE TO RELATED APPLICATION

This application is a division of application Ser. No. 10/410,499, filed Apr. 7, 2003, the entire disclosure of which is hereby incorporated by reference herein.

FIELD OF THE INVENTION

The present invention relates to an apparatus and process for affixing a closure to a receptacle, and more particularly, to a work feeding process wherein either the end closure or the open topped container is transported or conveyed to an assembly station and further to a seaming process including curling overlapping portions of the end closure and the open ended container into a toroidal bead that lies adjacent the upstanding wall portion of the said container to thereby form an air tight joint.

BACKGROUND OF THE INVENTION

Container seaming machines have been in use in the industry for many years. Referring to FIGS. 1 and 2, a typical container closure operation consists of an infeed conveyor 20 that feeds a constant supply of evenly-spaced, open containers 22 (e.g., metal cans) to a seaming machine 24. Just prior to reaching the seaming machine 24, a cover feed assembly 26 places an end closure 28 over the container opening at a position referred to herein as the "make-up point" 30. The cover feed assembly 26 includes a rotating cover feed turret 32 that moves the end closures 28 along a predefined path. As shown in FIG. 15, the cover feed assembly 26 is formed from a number of separate parts including dual guide sections 34, 38 mounted on the underside of a machine plate 36 and secured with several small bolts (not shown). The end closures 28 are fed from a cover magazine 46 at a predefined rate.

The container 22 has a small outwardly extending flange 48 about its upper opening. The end closure 28 has a similar flange 50, called "curl". See FIGS. 17 and 15. After the container 22 receives an end closure 28, the combination enters the seaming machine 24 where one or more shaft assemblies 52 (see FIG. 2) fold the flanges 48 and 50 to form an air tight seam. Referring back to FIG. 1, a discharge turret 54 moves the sealed containers along a discharge conveyor 56 for further processing.

In more detail and referring to FIG. 2, the seaming machine 24 includes a lifter table 60 and a seaming head 62 connected to the table 60 via various supports (not shown). Both the lifter table 60 and seaming head 62 are rotatably connected to a central spindle 64 and are arranged to so rotate in unison at a predefined rate. An upper seaming cam 66 is provided above the seaming head 62, though, the cam 66 does not rotate (or at least not at the same speed as the head 62 and table 60). The lifter table 60 has multiple stations 68 that each support an individual container 22. In some embodiments, these stations include "lifters" 70 that physically lift the container 22 upward during the seaming process.

The seaming head 62 includes multiple shaft assemblies 52 outwardly spaced about the seaming cam 66. In FIG. 2, a single shaft assembly is shown for clarity of illustration only. In known machines, there may be anywhere from 1 to 18 shaft assemblies 52 spaced about the head 62. The shaft assemblies 52 provide the components necessary to form a folded seam between a container 22 and its corresponding lid 28. In one embodiment, the shaft assemblies each include an upright shaft 70 that transmits a rotary motion to a pair of rollers 72, 74 via a support block 76. The head assembly also includes multiple chucks 80, one at each container station 68.

Still referring to FIG. 2, during the closure process, an unjoined container 22 and end closure 28 are placed at a station 68 where they are held between a lifter 70 and a chuck 80. Because conventional lids 28 include concentric rings that surround slightly sunken circular areas, the chuck contacts the upper surface of the lid, supporting the chuck wall portion of the lid and providing as such an anvil to perform the seaming operation.

As stated above, the seaming head and lifter table are rotating about the centerline of the spindle 64 during the seaming process. This allows a constant flow of containers through the seaming machine without having to stop the assembly to load and unload the open and sealed containers, respectively. In addition, each container 22 is rotating about its own central axis as well. To close the joint, the rollers 72, 74 of the shaft assembly press the combined flanges 48, 50 against the chuck 80, causing them to deform into a desired shape. The rollers 72, 74 have profiled grooves at their outer circumference that bend the flanges in a specific manner, thus ensuring a perfect seam.

Referring to FIG. 3, prior art shaft assembly 52 includes an upright shaft 70 that is located between adjacent container stations. First and second rollers, 72 and 74, respectively, are connected to the shaft 70 via block 76. The first roller 72 is sized and shaped to effectuate an initial partial curling of a downstream container 82. The second roller 74 is sized and shaped to effectuate a final curling of an upstream container 84. Thus, the shaft assembly operates on two separate containers. The rollers 72 and 74 act on the containers from the stations located to each side of the shaft. Stated differently, a single container is sealed using two separate shaft assemblies. In another embodiment of a shaft assembly (not shown), a single shaft is used with a single roller, with two such shaft assemblies being provided for each station.

The rollers 72 and 74 accomplish their tasks by being pressed against the flanges while the container 22 is rotated about its longitudinally central axis. The position of the block 76 determines which roller will be engaged with a container. The block 76 is connected to the lower end of the shaft 70. Rotary motion is transmitted to the block 76 via first and second cam followers 86 and 88 that are located at the upper end of the shaft 70. See FIG. 2. The cam followers 86 and 88 follow the contours of the seaming cam 66 as the seaming head 62 and lifter table 60 rotate relative to the seaming cam 66. The first cam follower 86 controls the position of the first roller 72. The second cam follower 88 controls the position of the second roller 74.

The above arrangements, while adequate, have a number of disadvantages. The manufacturer must provide machines that are capable of having varying numbers of stations. Each change in the number of stations will require a separate, redesigned shaft assembly to adjust the roller arm length and roller pitch. Similarly, it is difficult and time-consuming for the customer to change the machine setup in this regard. In addition, the cover feed assembly is difficult to install. When changing from one end closure size to another, the entire assembly must be reconfigured and the three part cover guides precisely reset. This is time consuming and often requires special skills, tools, and knowledge.

SUMMARY OF THE INVENTION

In accordance with teachings of the present invention, a seaming machine is described for forming an air tight joint between a container and an end closure. The machine includes a seaming head with multiple shaft assemblies and a lifter table located below the seaming head and including multiple corresponding container stations. During use, the lifter table and seaming head rotate in unison about a central spindle, thereby moving a stream of containers through the seaming machine. A single shaft assembly is provided at each station to perform a two-step seaming operation on its corresponding container. In preferred embodiments, the shaft assembly includes first and second rollers.

In accordance with other aspects of this invention, in one embodiment, a seaming cam is mounted above a seaming head. The seaming head and lifter table rotate relative to the seaming cam during use. The shaft assembly includes first and second cam followers arranged to follow the contour of the seaming cam as the lifter table and seaming head rotate. The motion of the first and second cam followers provide rotary input to the rollers to accomplish the two-step seaming operation.

In accordance with further aspects of this invention, a first cam follower acts as a master cam follower that positions the first roller to accomplish the first seaming step, the second cam follower being a slave to the first cam follower during the first seaming step. The second cam follower acts as a master cam follower that positions the second roller to accomplish the second seaming step, while the first cam follower is a slave to the second cam follower during the second seaming step.

In accordance with other aspects of this invention, the shaft assembly includes an upright shaft having upper and lower ends. A block is attached to the shaft lower end. The first and second rollers are rotatably connected to opposite ends of the block about upright axes. The middle region of the block is connected to the lower end of the upright shaft and can rotate with this shaft about the centerline of that shaft. In one embodiment, the block is fixed relative to the shaft during use.

In accordance with further aspects of this invention, an improvement to a seaming process for affixing an end closure to a container opening is described. The container is located at a processing station in a container closing machine. The improvement includes using a shaft assembly adjacent to each processing station to perform a seaming operation on a single container during use. The shaft assembly includes first and second rollers. The first roller performs a first seaming step resulting in partial closure of the joint, and the second roller performs a second seaming step resulting in final forming of the joint.

In accordance with other aspects of this invention, a cover feed assembly is described for use in providing end closures to a seaming machine. The assembly includes a unitary plate having a lower surface, a shallow channel in the lower surface for holding end closures, and inwardly-extending flanges bounding the side walls of the channel. In one embodiment, the channel is formed in the unitary plate by being machined out of a solid material.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
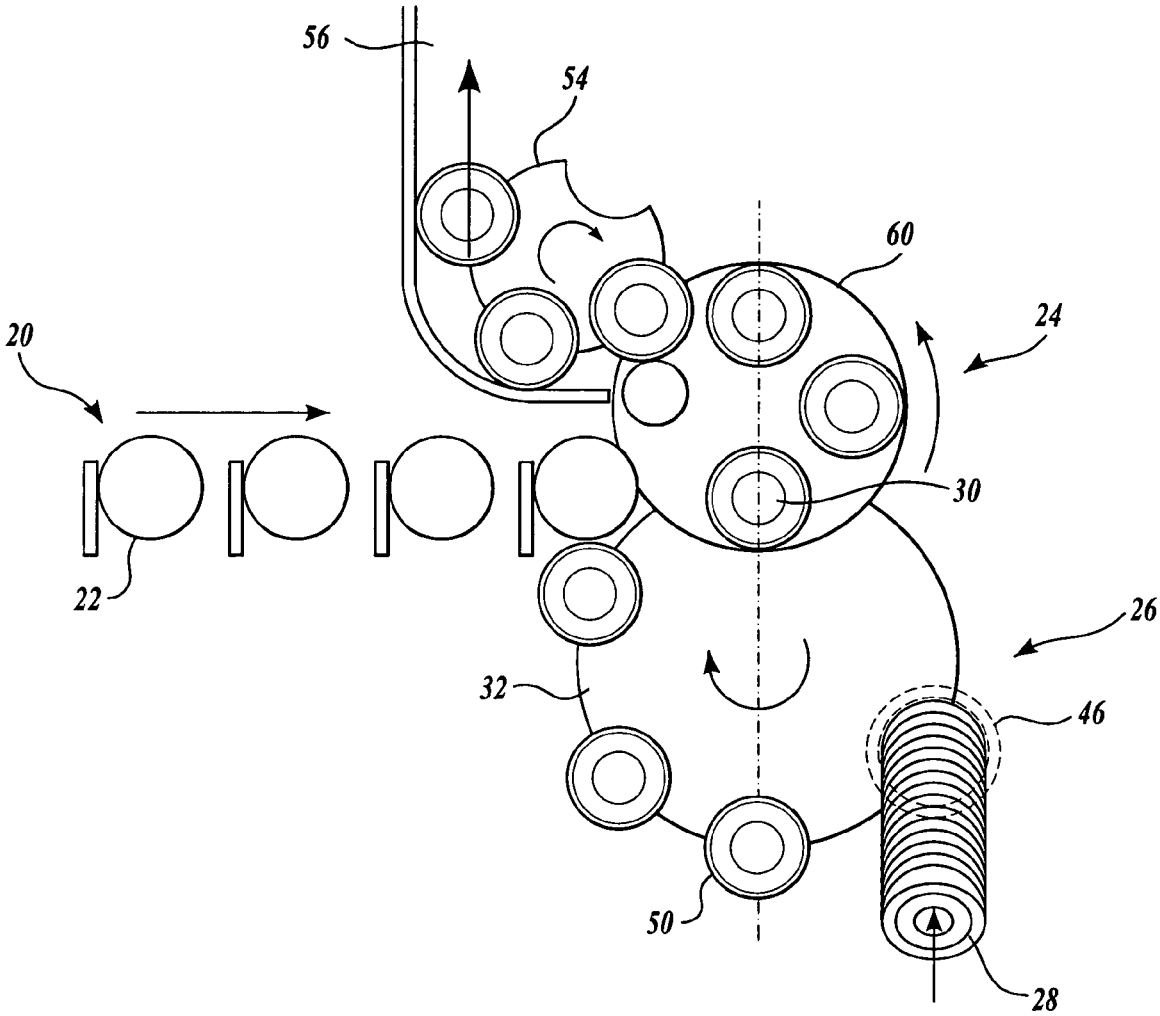
Fig.1. PRIOR ART
FIG. 1 is a schematic plan view diagram of a prior art seaming process showing the general flow of filled containers through a seaming machine.
Figure 2:
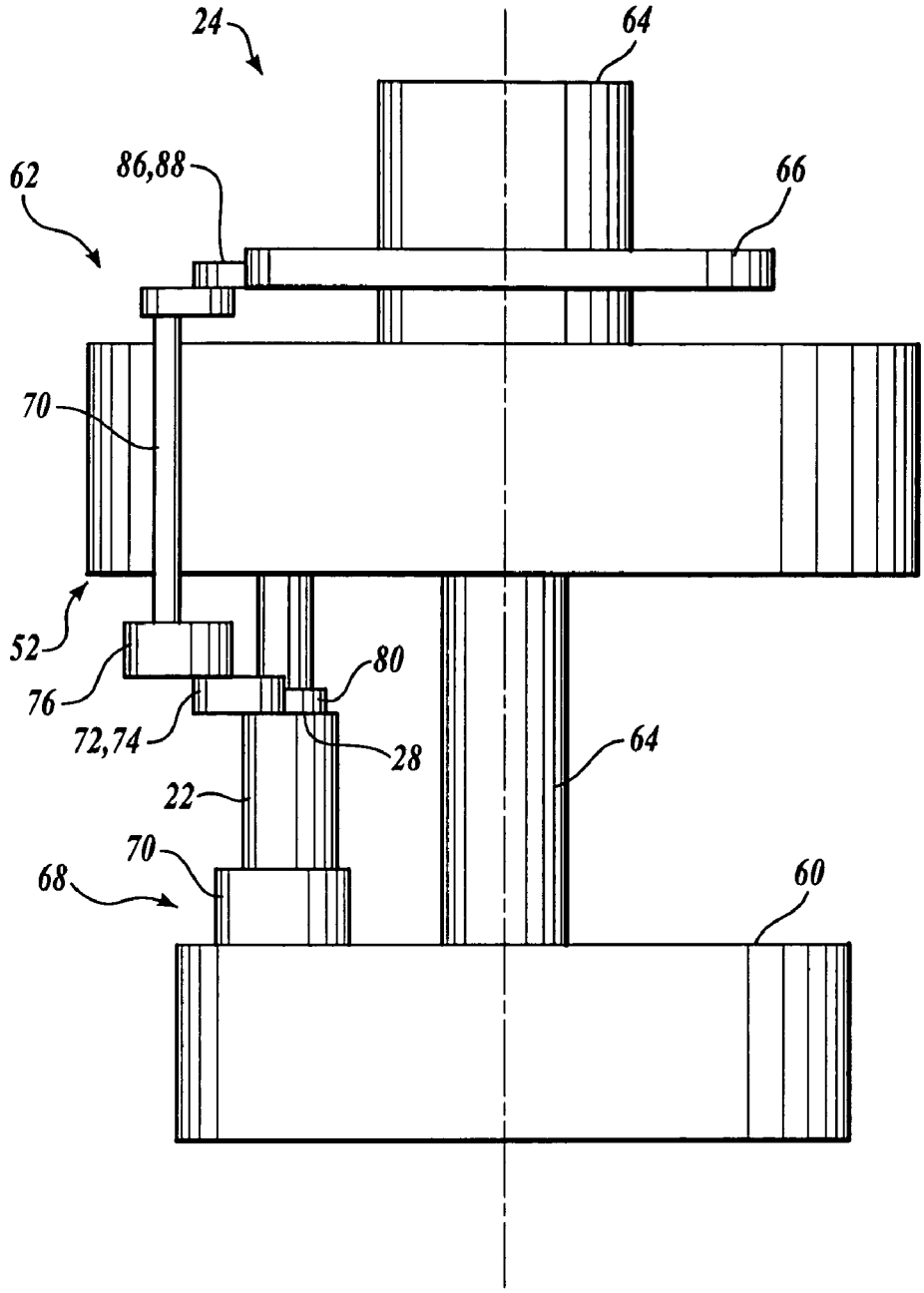
Fig.2. PRIOR ART
FIG. 2 is a schematic side view diagram of a prior art seaming machine, though showing only a single seaming stations for illustrative purposes.
Figure 3:
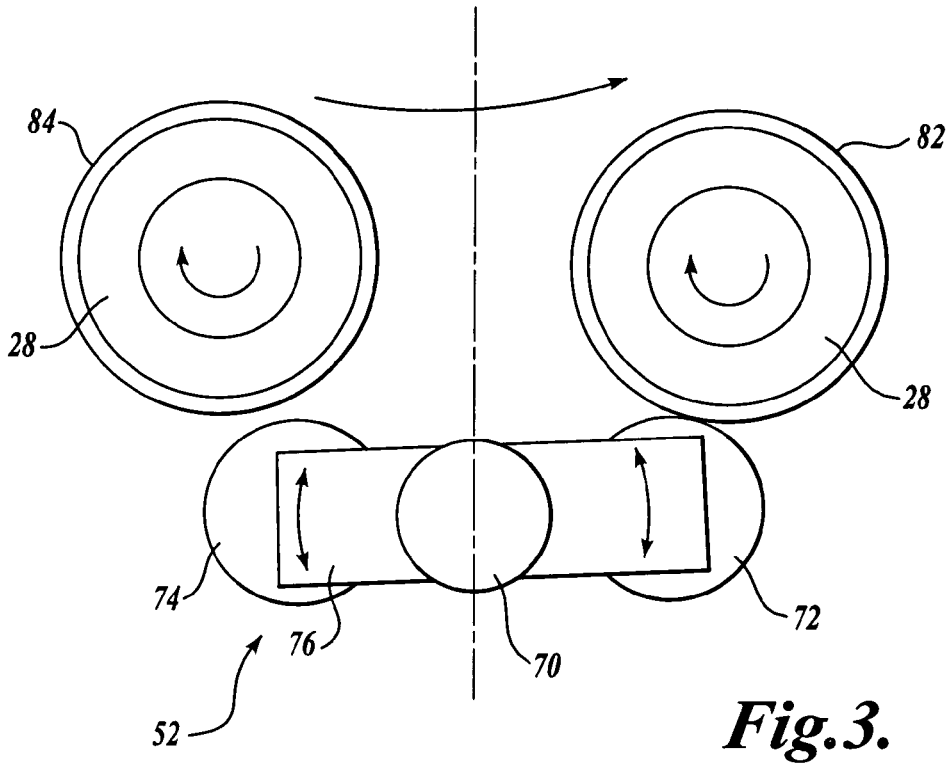
Fig.3. PRIOR ART
FIG. 3 is a schematic plan view diagram of a prior art shaft assembly performing a seaming operation on first and second containers.
Figure 4:
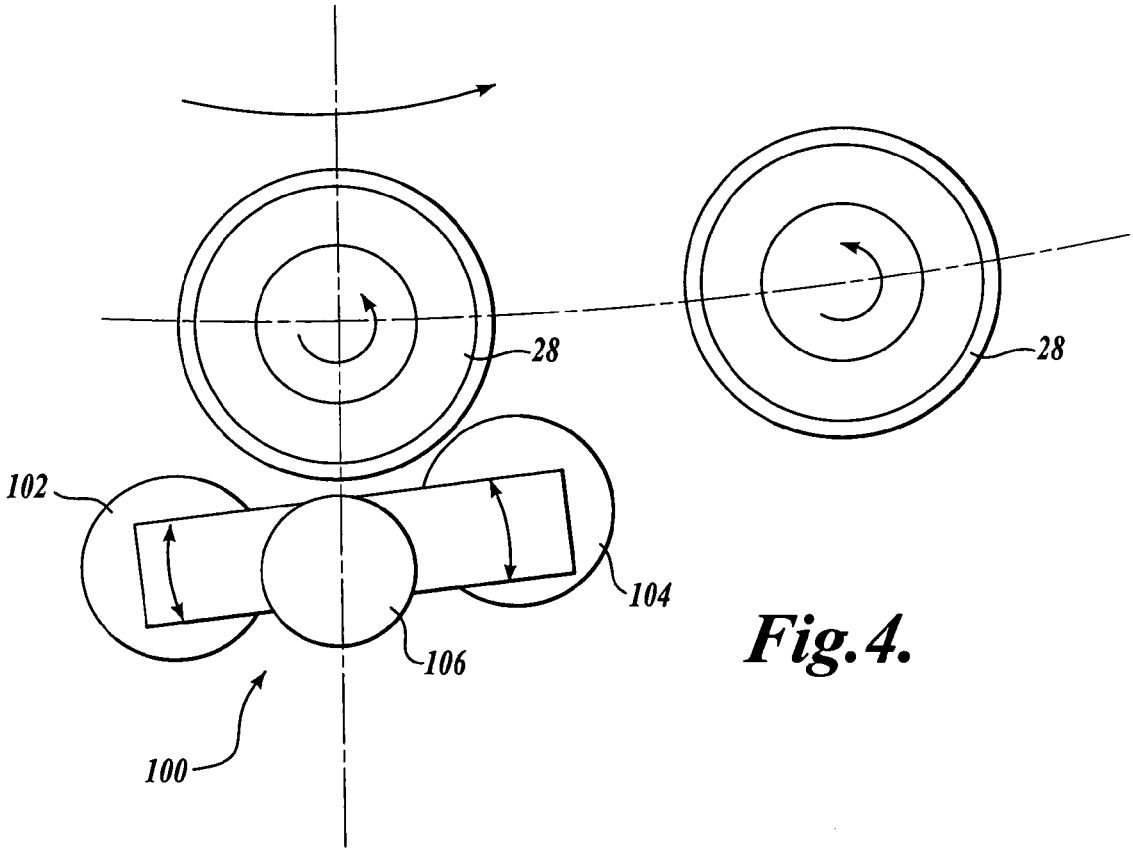
FIG. 4 is a schematic plan view diagram of one embodiment of the present invention seaming process.
Figure 5:
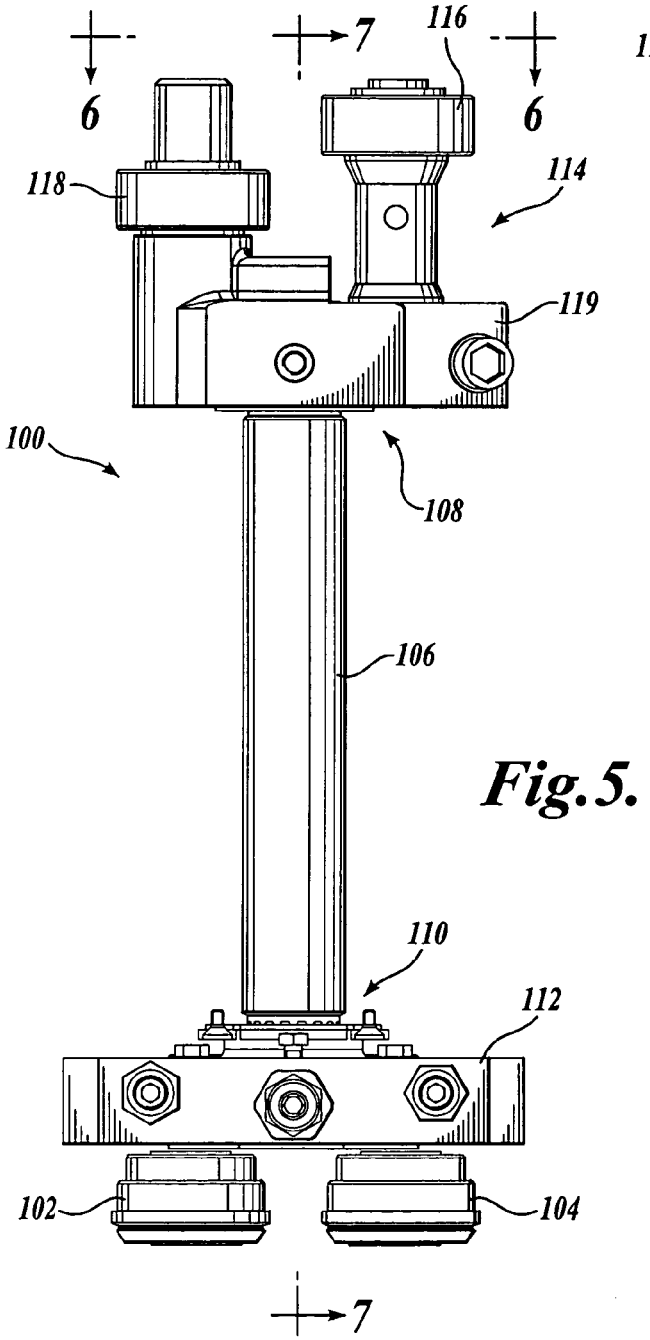
FIG. 5 is a side view of one embodiment of a shaft assembly formed in accordance with the present invention for use in the process of FIG. 4.
Figure 6:
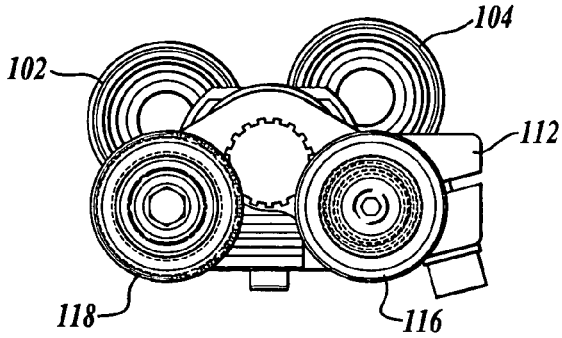
FIG. 6 is an end view taken along line 6—6 of FIG. 5.

The present invention includes a number of unique features that may be used jointly in a single seaming assembly, or separately, as circumstances warrant. One aspect is the unique use of a single shaft assembly to perform a two-step seaming operation on a single station. Referring to FIG. 4, a shaft assembly 100 includes a first roller 102 and a second roller 104. The shaft assembly 100 is located radially outward of its respective station, relative to the axis of rotation of the lifter table 60 and seaming head 62. The shaft assembly 100 is connected to the seaming head 62 in a manner that allows the rotary motions described below.

During use, the first roller 102 performs a first seaming step resulting in partial closure of the joint, and the second roller 104 performs a second seaming step resulting in final closure of the same joint. As will be appreciated by those skilled in the art, because the shaft assembly is dedicated to a single station, there is no need to alter the shaft assembly 100 should the total number of stations in a seaming machine be changed. The shaft assemblies are standardized to a particular station radius and as such are applicable to that machine regardless of the number of stations.

Referring to FIGS. 5, 6, 7, and 8, one embodiment of the shaft assembly 100 includes an upright shaft 106 having upper and lower ends 108 and 110, a block 112 having opposite ends and a middle region, and a cam assembly 114. The first roller 102 and second roller 104 are rotatably connected to the opposite ends of the block 112 about upright axes. The middle region of the block 112 is connected to the lower end 108 of the upright shaft 106. During use, the block and shaft rotate together about the centerline of the shaft.

The cam assembly 114 includes a first cam follower 116 and a second cam follower 118. The cam followers 116 and 118 connect to a support member 119 that is attached to the upper end 108 of the shaft 106. The support member 119 and shaft 106 rotate together about the centerline of the shaft. During use, the cam followers 116 and 118 are located adjacent the seaming cam 66. The cam followers 116 and 118 follow the contour of the seaming cam 66 and, in doing so, cause the support member 119 to pivot back and forth. This motion is transmitted through the shaft 106 and block 112 to result in the first and second rollers 102 and 104 pivoting laterally in and out in a like manner.

Each cam follower is responsible for directing one of the rollers to perform its seaming step. When not performing this step, the cam follower simply responds in a complementary manner to the direction of the other cam follower. For example, to conduct the first step, the first cam follower 116 is, at first, a master cam follower and is arranged to follow the contour of the seaming cam 66 as the lifter table 60 and seaming head 62 rotate about the spindle 64. The second cam follower 118 is located below the first cam follower 116 and is, at first, a slave cam follower, designed to complement the motions of the first cam follower 116 during the first step of the seaming operation. For the second step, the role of the cam followers (master and slave) is reversed. The second cam follower 118 becomes the master cam follower, while the first cam follower 116 becomes the slave cam follower. It has been found that the use of the above described arrangement is a more efficient and less expensive solution for controlling the movement of the shaft assembly than the box type cams which are currently used in known single-shaft assembly systems.

Figure 7:
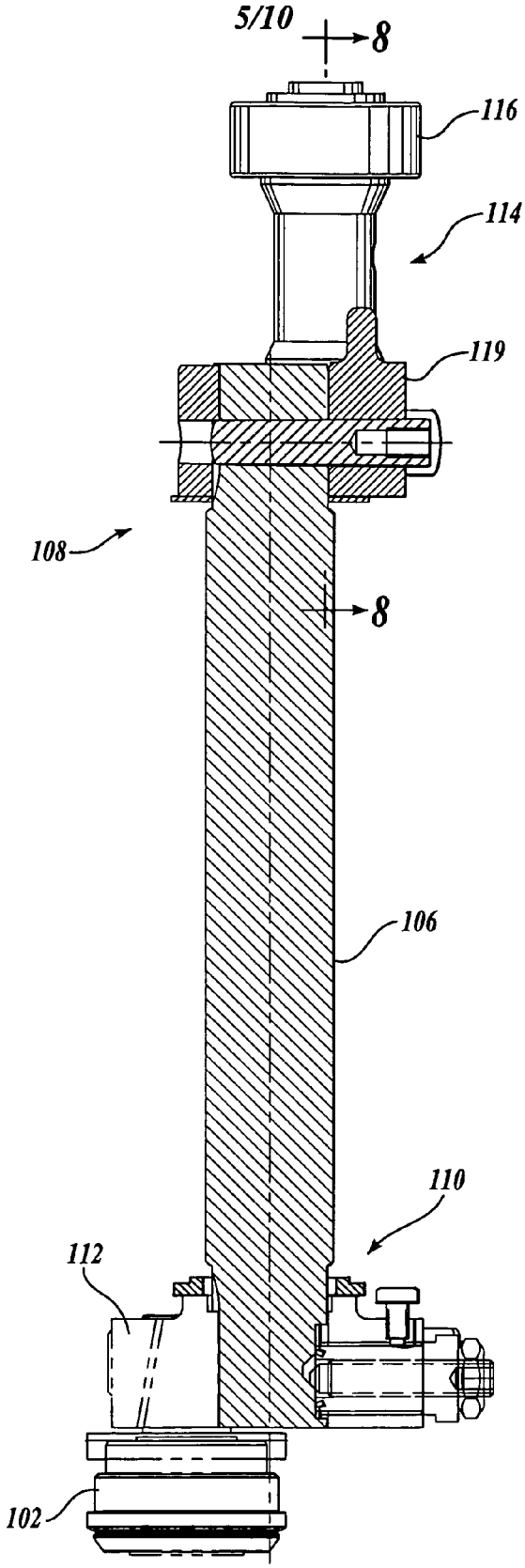
FIG. 7 is a cross-sectional side view taken along line 7—7 of FIG. 4.
Figure 8:
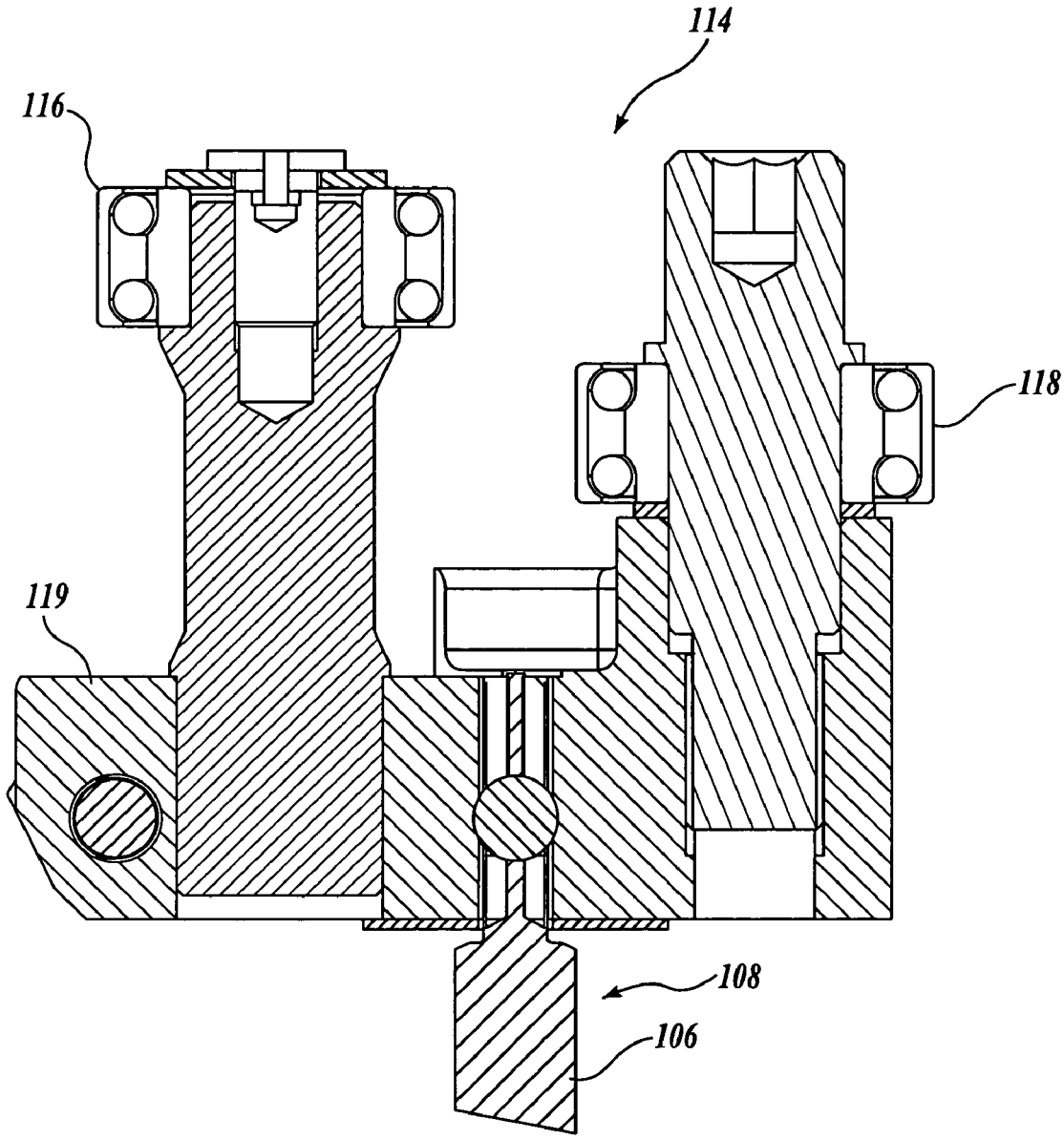
FIG. 8 is a cross-sectional side view taken along line 8—8 of FIG. 4.

The cam assembly may also include eccentric devices to facilitate seam setting procedures at the first and second rollers. Further, eccentric shafts may be used at the first and second cam followers to reduce fabrication tolerances at the cams. In FIG. 7, height adjustment components are provided to eliminate axial clearance.

Figure 9:
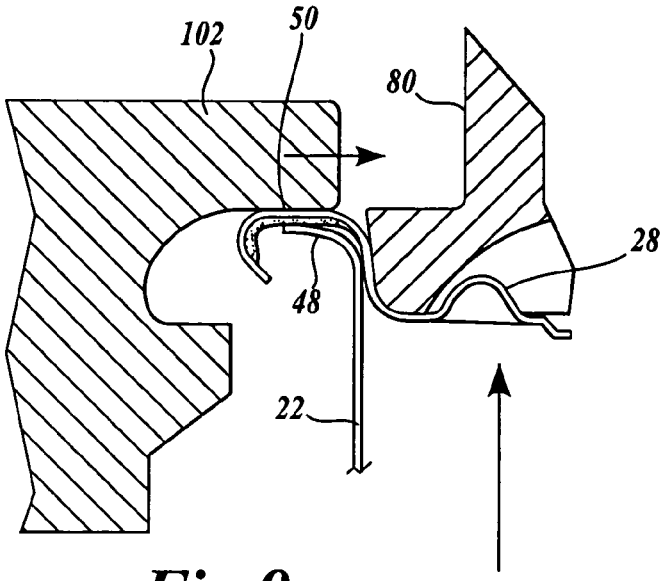
FIGS. 9, 10, and 11 are cross-sectional side views of one embodiment of a seaming operation.
Figure 10:
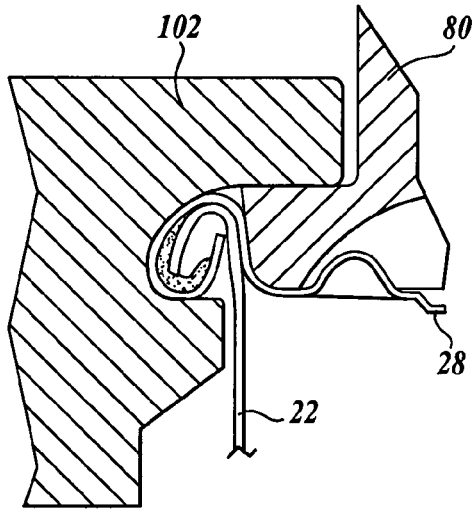
Figure 11:
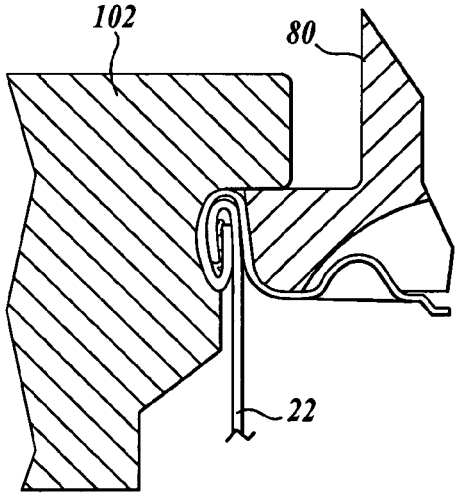
Figure 12:
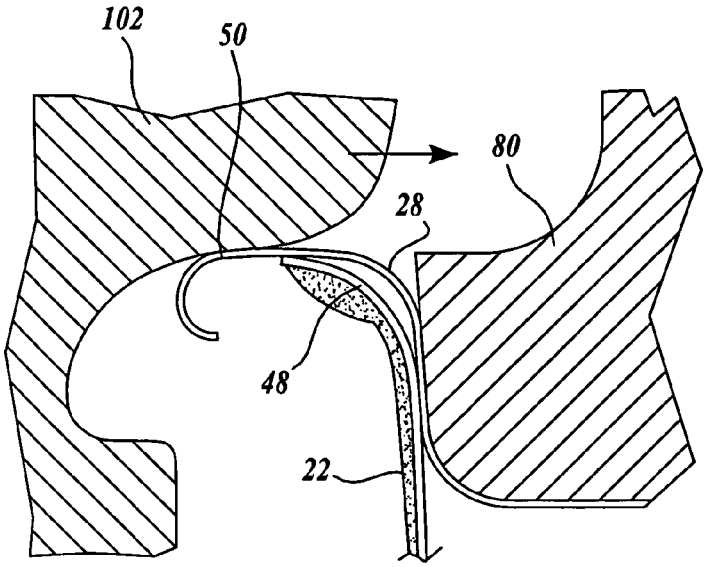
FIGS. 12, 13, and 14 are cross-sectional side views of another embodiment of a seaming operation.
Figure 13:
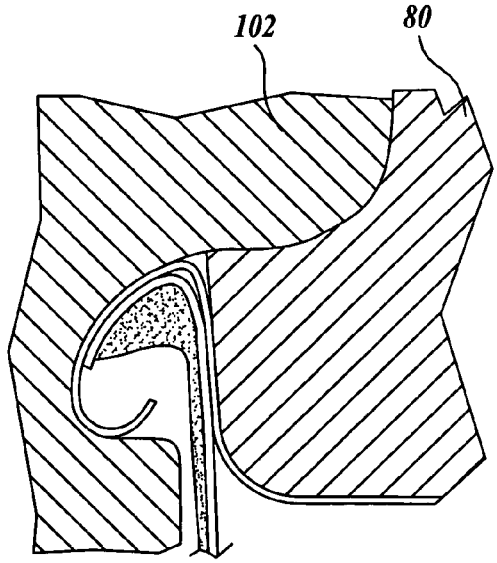
Figure 14:
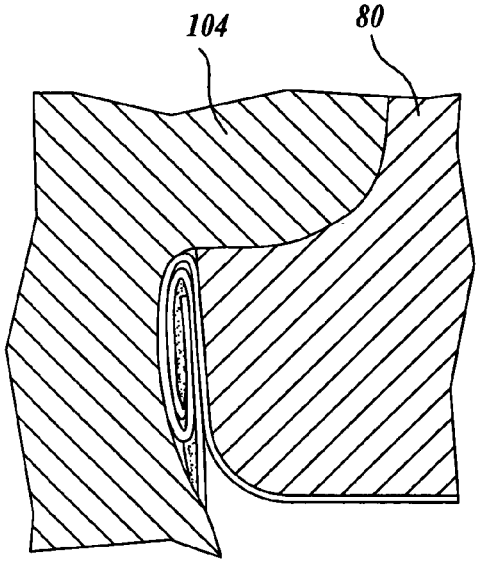

FIGS. 9, 10, and 11 illustrate one embodiment of a seaming operation in which the first and second rollers 102 and 104 press the combined flanges 48, 50 against the chuck 80, causing the flanges to deform into a desired shape. FIGS. 12, 13, and 14 illustrate a second embodiment of a seaming operation. The first and second rollers 102 and 103 have groove shapes that include a number of rounded edges.

Figure 15:
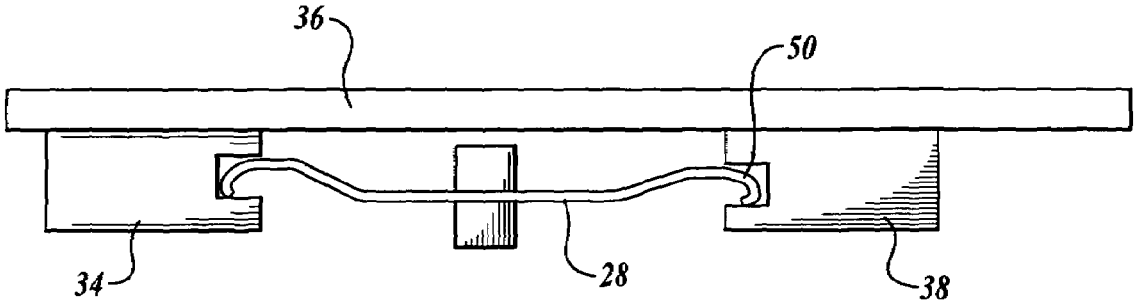
Fig.15. PRIOR ART
FIG. 15 is a cross-sectional view of a prior art channel.
Figure 17:
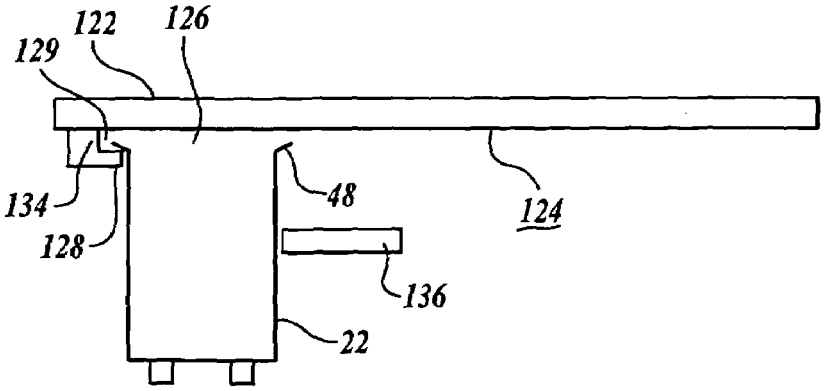
FIG. 17 is a side view of a container just prior to entering a make-up point.
Figure 16:
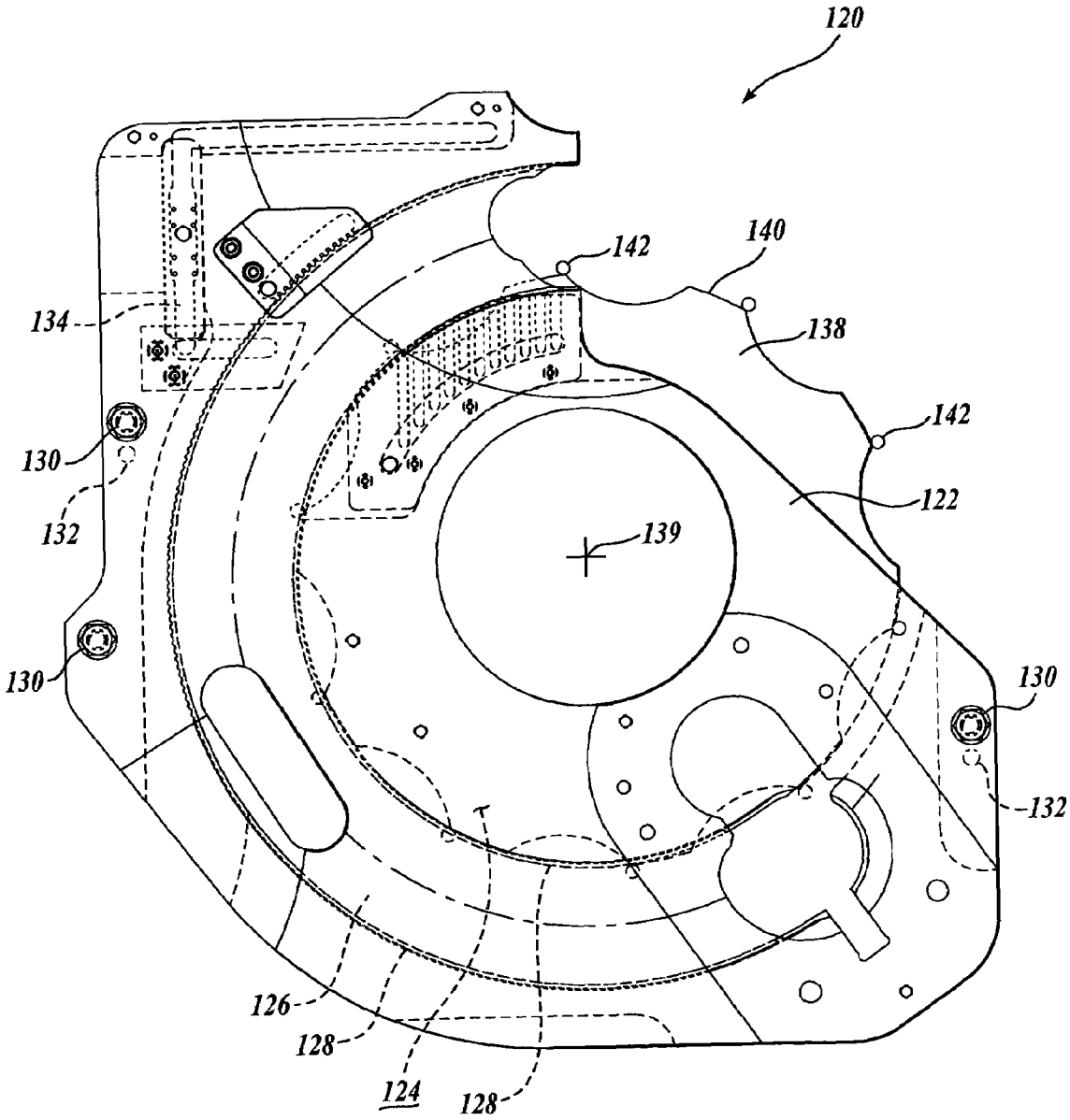
FIG. 16 is a top-down plan view of one embodiment of a unitary cover plate formed in accordance with the present invention.

Referring now to FIGS. 15, 16, and 17, a unique cover feed assembly 120 is described for providing end closures 28 to the make-up point 30. Referring to FIG. 16, the cover feed assembly 120 includes a unitary plate 122 having a lower surface 124 and a shallow channel 126 in the lower surface for holding end closures 28. Inwardly-extending flanges 128 bound the side walls 134 of the channel 126 to define undercut portions 129. The channel 126 may be formed in the unitary plate 122 by being machined out of a solid material, or alternatively, may be formed in the unitary plate 122 by being molded in the plate during formation.

Installing the unitary plate 122 requires only a minimal number of fixing bolts, e.g., the embodiment shown has as few as three fastener locations 130. These particular positions are easy to access during installation, maintenance, and cleaning. In addition, various locating pins 132 help to correctly align and position the plate during installation. Referring to FIG. 17, the particular plate 122 shown has the added benefit of holding a container guide 134 that can stay attached to the plate 122 while still allowing a wide range of container heights to be handled. Since the container guide is bolted to the machine plate 122, the guide is adjusted together with the plate during reconfigurations. In prior art configurations, a guide is mounted on a nearby frame member of the machine itself and is not easily accessed. The prior art guide must be manually adjusted whenever the machine plate position is altered in height in order to adjust to different container heights. A side guide infeed conveyor 136 may also be used to align containers 22.

Referring back to FIG. 16, as installed, a cover feed turret 138 is located below the unitary plate 122 and adapted to rotate relative to the unitary plate about an upright central axis 139. The turret 138 includes a scalloped peripheral edge 140 and a number of push pins 142 spaced along this edge at predetermined locations. During use, the push pins 142 move the end closures 28 from one location to another within the shallow channel 126 from the cover magazine to the seaming station.

As will be appreciated from a reading of the above, the present invention seaming machine and process is more efficient and less costly to manufacture than known systems. The use of a single shaft assembly at each station allows a manufacturer to offer customers seaming machines that have different numbers of stations without having to redesign and separately manufacture the shaft assembly, since the shaft assemblies will all be based on the same pitch circle diameter at the stations.

This is not the case with the prior art configuration, since modifying the number of stations in a machine leads to different lengths of seaming arms being required. Further, on their turn they have the disadvantage that the changing seaming torque causes different angle deflections on the standard size seaming shaft, which makes the proper setting-up of the seaming station more difficult and requiring more time. It can lead also to "side seam jump-over" and "seam bumps". Stated differently, the present invention shaft assembly can be standardized for use with various machines. Since the same shaft assemblies can be used, the process is less costly in terms of tooling stock costs. In addition, using a single shaft assembly on a single container results in a simpler process and fewer setting errors.

Constant seaming arm lengths also provide for better seam control, thereby allowing thinner container and cover materials. In addition, the settings that position the rollers relative to the block can be maintained in the shaft assemblies if these need to be changed over when going from one can size to the other and back.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A seaming machine for forming an air tight joint between a container and an end closure, the machine comprising:

(a) a seaming head rotatably connected to a central spindle, the head including multiple shaft assemblies; and (b) a lifter table located below the seaming head and including multiple seaming stations, each station capable of receiving a container, wherein the lifter table and seaming head are rotatable in unison about the centerline of the spindle, thereby moving a stream of containers through the seaming machine;

(c) wherein a shaft assembly is provided at each station to perform a seaming operation on a corresponding container; and an end closure feed assembly for providing end closures, the end closure feed assembly comprising:

an end closure magazine;

a unitary plate having a lower surface, a shallow channel in the lower surface of the unitary plate for holding and guiding end closures the entire distance from the end closure magazine to a seaming station where the end closure is placed on a container, said channel including undercut side portions to define inwardly-extending flanges bounding the side walls of the channel for retaining and guiding the end closures within the channels during movement of the closures along the length of the channel from the magazine to the seaming station; and an end closure feed turret located below the unitary plate and adapted to rotate relative to the unitary plate about an upright axis, the turret advancing end closures from one location to another within the channel as the turret rotates.

2. The seaming machine according to claim 1, wherein the unitary plate is composed of a singular plate stock.

3. The seaming machine according to claim 1, wherein the unitary plate is composed of a singular molded unit.

4. The seaming machine according to claim 1, wherein the turret comprising a peripheral edge and a number of push pin space along the peripheral edge of predetermined locations there along, wherein during rotation of the turret, the push pins move the end closure from one location to another within the channel.

* * * * *